US008658579B2

(12) United States Patent
Daegling

(10) Patent No.: US 8,658,579 B2
(45) Date of Patent: Feb. 25, 2014

(54) LUBRICATING GREASE COMPOSITIONS

(75) Inventor: Stefan Daegling, Hamburg (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/999,455

(22) PCT Filed: Jun. 18, 2009

(86) PCT No.: PCT/EP2009/057613
§ 371 (c)(1),
(2), (4) Date: Apr. 13, 2011

(87) PCT Pub. No.: WO2009/153317
PCT Pub. Date: Dec. 23, 2009

(65) Prior Publication Data

US 2011/0183877 A1 Jul. 28, 2011

(30) Foreign Application Priority Data

Jun. 19, 2008 (EP) ..... 08158611

(51) Int. Cl.
*C10M 117/02* (2006.01)
*C10M 123/04* (2006.01)

(52) U.S. Cl.
USPC ..... 508/519; 508/469; 508/539; 508/591

(58) Field of Classification Search
USPC ..... 508/519
See application file for complete search history.

(56) References Cited

U.S. PATENT DOCUMENTS

| | | | | |
|---|---|---|---|---|
| 3,015,624 | A * | 1/1962 | McBurnett et al. | 508/519 |
| 4,315,825 | A * | 2/1982 | Schweizer et al. | 508/485 |
| 4,842,752 | A * | 6/1989 | Hardy et al. | 508/231 |
| 5,714,444 | A * | 2/1998 | Yokouchi et al. | 508/539 |
| 5,846,916 | A * | 12/1998 | Akabe et al. | 508/211 |
| 6,214,774 | B1 * | 4/2001 | Nozaki et al. | 508/209 |
| 6,232,278 | B1 * | 5/2001 | Shibayama et al. | 508/539 |
| 6,239,085 | B1 | 5/2001 | Slack | 508/539 |
| 6,300,288 | B1 * | 10/2001 | Scharf et al. | 508/221 |
| 6,417,143 | B1 * | 7/2002 | Mikami et al. | 508/465 |
| 7,635,669 | B2 * | 12/2009 | Culley | 508/519 |
| 2003/0176298 | A1 | 9/2003 | Nakatani et al. | 508/398 |

FOREIGN PATENT DOCUMENTS

| | | | |
|---|---|---|---|
| CN | 1136074 | 1/2004 | |
| EP | 218208 | 4/1987 | |
| EP | 629689 | 12/1994 | C10M 169/06 |
| EP | 0668342 | 2/1995 | C10G 65/04 |
| EP | 0776959 | 6/1997 | C10G 65/04 |
| EP | 1666574 | 6/2006 | C10M 133/16 |
| GB | 767448 | 2/1957 | |

(Continued)

OTHER PUBLICATIONS

Database WPI Week 198436 XP002495573 & JP59131698.

(Continued)

*Primary Examiner* — Ellen McAvoy

(57) ABSTRACT

Lubricating grease composition comprising: (i) a base oil; and (ii) a thickener system comprising (i) a lithium soap of a first carboxylic acid selected from $C_{12}$-$C_{24}$ hydroxy carboxylic acids and (ii) a lithium soap of a second carboxylic acid selected from $C_{12}$-$C_{24}$ branched carboxylic acids, $C_{12}$-$C_{24}$ dihydroxy carboxylic acids and mixtures thereof. The lubricating grease compositions according to the present invention have improved oil bleeding and shear stability properties, as well as improved grease lifetime and increased relubrication intervals.

30 Claims, 6 Drawing Sheets

(56) References Cited

FOREIGN PATENT DOCUMENTS

| | | | |
|---|---|---|---|
| GB | 2340554 | 2/2000 | ..... F16C 33/62 |
| JP | 59131698 | 7/1984 | ..... C10M 5/14 |
| WO | WO 9821788 | 5/1998 | ..... H01S 3/09 |
| WO | WO 9920720 | 4/1999 | ..... C10M 143/08 |
| WO | WO 9941332 | 8/1999 | ..... C10G 69/02 |
| WO | WO 0008115 | 2/2000 | ..... C10G 45/58 |
| WO | WO 0014179 | 3/2000 | ..... C10G 2/00 |
| WO | WO 0014183 | 3/2000 | ..... C10G 45/58 |
| WO | WO 0014187 | 3/2000 | |
| WO | WO 0014188 | 3/2000 | ..... C10M 105/04 |
| WO | WO 0015736 | 3/2000 | ..... C10G 65/00 |
| WO | WO 0118156 | 3/2001 | ..... C10M 101/02 |
| WO | WO 2001057166 | 8/2001 | |

OTHER PUBLICATIONS

Scharf C R, et al: The enhancement of Grease structure through the use of fuctionalized polymer systems, NLGI Spokesman, Kansas City, MO, US, vol. 59, No. 11, Oct. 1, 1995, pp. 8-16.

American Petroleum Institute, Publication 1509, Downstream Segment; "Engine Oil Licensing and Certification System", 15th Edition, Appendix E, Apr. 2002.

* cited by examiner

LUBRICATING GREASE COMPOSITIONS

PRIORITY CLAIM

The present application claims priority of European Patent Application No. 08158611.7 filed Jun. 19, 2008.

FIELD OF THE INVENTION

The present invention relates to lubricating grease compositions, particularly to lubricating grease compositions thickened with lithium soap having improved oil bleeding and shear stability properties, as well as improved grease lifetime and increased relubrication intervals.

BACKGROUND OF THE INVENTION

The primary purpose of lubrication is separation of solid surfaces moving relative to one another, to minimise friction and wear. The materials most frequently used for this purpose are oils and greases. The choice of lubricant is mostly determined by the particular application.

Lubricating greases are employed where heavy pressures exist, where oil drip from the bearings is undesirable or where the motion of the contacting surfaces is discontinuous so that it is difficult to maintain a separating film in the bearing. Because of design simplicity, decreased sealing requirements and less need for maintenance, greases are almost universally given first consideration for lubricating ball and roller bearings in electric motors, household appliances, automotive wheel bearings, machine tools or aircraft accessories. Greases are also used for the lubrication of small gear drives and for many slow-speed sliding applications.

Lubricating greases consist primarily of a fluid lubricant, such as an oil, and a thickener. Essentially, the same type of oil is employed in compounding a grease as would normally be selected for oil lubrication. Fatty acid soaps of lithium, calcium, sodium, aluminium and barium are most commonly used as thickeners.

Due to ever increasing demands for higher performance, it would be desirable to provide greases which exhibit improved lubrication properties, and in particular, reduced oil bleeding, improved shear stability and increased grease lifetime.

SUMMARY OF THE INVENTION

According to the present invention there is provided a lubricating grease composition comprising:

(a) a base oil; and (b) a thickener system comprising (i) a lithium soap of a first carboxylic acid selected from $C_{12}$-$C_{24}$ hydroxy carboxylic acids and (ii) a lithium soap of a second carboxylic acid selected from $C_{12}$-$C_{24}$ branched carboxylic acids, $C_{12}$-$C_{24}$ dihydroxy carboxylic acids and mixtures thereof.

It has surprisingly been found that the grease compositions of the present invention exhibit reduced oil bleeding, reduced oil separation and improved shear stability, as well as increased grease lifetime. Thus by employing the grease, the number of reapplications necessary to maintain satisfactory lubrication of the mechanical part to which the grease is applied is considerably reduced.

Accordingly, the present invention further provides the use of a lubricating composition as described hereinbelow for reducing oil bleeding.

According to the present invention there is further provided the use of a lubricating composition as described hereinbelow for improving shear stability.

DETAILED DESCRIPTION OF THE INVENTION

The lubricating grease of the present invention comprises, as an essential component, a base oil. There are no particular limitations regarding the base oil used in the lubricating compositions according to the present invention, and various conventional base oils may be conveniently used. The base oil may be of mineral or synthetic origin. Base oils of mineral origin may be mineral oils, for example produced by solvent refining or hydro-processing. Base oils of synthetic origin may typically be mixtures of $C_{10-50}$ hydrocarbon polymers, for example liquid polymers of alpha-olefins. They may also be conventional esters, for example polyol esters. The base oil may also be a mixture of these oils. Preferably the base oil is that of mineral origin sold by the Royal Dutch/Shell Group of Companies under the designations "HVI" or "MVIN". Synthetic hydrocarbon base oils, for example those sold by the Royal Dutch/Shell Group of Companies under the designation "XHVI" (trade mark) may also be used.

Preferably, the lubricating composition comprises at least 30 wt. % base oil, preferably at least 50 wt. %, more preferably at least 70 wt. %, based on the total weight of the lubricating composition.

In addition to the base oil, the lubricating grease compositions of the present invention further comprise a thickener system comprising (i) a lithium soap of a first carboxylic acid selected from $C_{12}$-$C_{24}$ hydroxy carboxylic acids and (ii) a lithium soap of a second carboxylic acid selected from $C_{12}$-$C_{24}$ branched carboxylic acids, $C_{12}$-$C_{24}$ dihydroxy carboxylic acids and mixtures thereof.

The amount of thickener system present in the grease is preferably from 2% to 30%, preferably from 5% to 20%, by weight of the composition.

More preferably the lithium soap of the $C_{12}$-$C_{24}$ hydroxy carboxylic acid is a $C_{16}$ to $C_{20}$ hydroxy fatty acid. A particularly preferred hydroxy fatty acid is hydroxystearic acid, for example, 9-hydroxy, 10-hydroxy, or 12-hydroxystearic acid, more preferably the latter. Ricinoleic acid which is an unsaturated form of 12-hydroxystearic acid having a double bond in the 9-10 position, can also be used. Other suitable hydroxy fatty acids include 12-hydroxybehenic acid and 10-hydroxypalmitic acid.

In addition to the lithium soap of a $C_{12}$-$C_{24}$ hydroxycarboxylic acid, the thickener further comprises a lithium soap of a second carboxylic acid selected from $C_{12}$-$C_{24}$ branched carboxylic acids, $C_{12}$-$C_{24}$ dihydroxy carboxylic acids and mixtures thereof.

Preferably, the $C_{12}$-$C_{24}$ branched carboxylic acid is a $C_{16}$ to $C_{20}$ branched carboxylic acid. A particularly preferred branched carboxylic acid is isostearic acid.

Preferably, the $C_{12}$-$C_{24}$ dihydroxy carboxylic acid is a $C_{16}$ to $C_{20}$ dihydroxy carboxylic acid. A particularly preferred dihydroxy carboxylic acid is dihydroxy stearic acid, for example, 9,10-dihydroxy stearic acid.

In preferred embodiments herein, the second carboxylic acid is a $C_{12}$-$C_{24}$ branched carboxylic acid, especially isostearic acid.

While not wishing to be limited by theory, it is believed that the second carboxylic acid modifies the crystallization of the $C_{12}$-$C_{24}$ hydroxy carboxylic acid in order to provide a grease which exhibits improved lubrication properties.

The first carboxylic acid and the second carboxylic acid are preferably present in a weight ratio of from 20:1 to 1:1, preferably from 10:1 to 1:1, more preferably from 8:1 to 3:1.

Another preferred component in the grease compositions herein is a polymer. Any suitable polymer may be used herein, but is preferably one which dissolves in or can be dissolved in the base oil. Preferred polymers for use herein are those which dissolve easily in mineral oil.

Suitable polymers for use herein include polymers and copolymers of ethylene and olefins. Examples of such polymers include polyethylene, polypropylene, polybutene, polyisobutylene, EPDM (ethylene propylene diene elastomer), and the like. Also suitable for use herein are polymers and copolymers of acrylic acid. Particularly preferred polymers for use herein are polymers and copolymers of ethylene and olefins, especially polyethylene and EPDM.

An example of an EPDM polymer is Nordel NR245 commercially available from Du Pont Dow Elastomers S.A. Examples of polyacrylate polymers are Luwax EAS 5 and Luwax ES 91014 commercially available from BASF Aktiengesellschaft, Ludwigshafen, Germany. Examples of polyethylene type polymers are Petrothene NA 204-000 commercially available from Equistar Chemicals LP, Houston, Tex., USA and Lupolene PE LD 1800S commercially available from Ultrapolymers Deutschland GmbH.

It is preferred that the polymer used herein has a molecular weight in the range of from 150,000 to 700,000, more preferably from 150,000 to 500,000.

The polymer is preferably present in an amount of from about 0.01% to about 10%, preferably from about 0.1% to about 5%, more preferably from about 0.1% to about 2%, by weight of composition.

Various conventional grease additives may be incorporated into the lubricating greases of the present invention, in amounts normally used in this field of application, to impart certain desirable characteristics to the grease, such as oxidation stability, tackiness, extreme pressure properties and corrosion inhibition. Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulphurised sperm oils of natural or synthetic origin, sulphurised lard, sulphurised esters, sulphurised fatty acid esters, and similar sulphurised materials, organo-phosphates for example according to the formula $(OR)_3P{=}O$ where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine; one or more antirust additives; one or more friction-modifying additives; one or more viscosity-index improving agents; one or more pour point depressing additives; and one or more tackiness agents. Solid materials such as graphite, finely divided molybdenum disulphide, talc, metal powders, and various polymers such as polyethylene wax may also be added to impart special properties.

To reduce friction levels, those skilled in the art have largely looked to using organic molybdenum-based formulations, and there are numerous proposals in patent literature of such lubricating compositions.

The present invention will now be described by reference to the following Examples.

EXAMPLES

The Lubricating greases of the Examples and Comparative Examples below were prepared by the following procedure.

50% of the base oil is charged in an autoclave together with 12-hydroxystearic acid, isostearic acid (if present) and lithium hydroxide monohydrate and 100 ml of water. The autoclave is closed and heated up to 145° C. After reaching the venting temperature the venting valve is opened and steam is released for 30 minutes. When the steam pressure is 0 bar, with the venting valve still open, heating is started up to a temperature of 215° C. After reaching a temperature of 215° C., the autoclave is cooled down with jacket cooling of 1° C./min to reach 165° C. After reaching 165° C. the remaining 50% of base oil is charged in the vessel, together with the dissolved polymer, if present. Then the product is cooled to 80° C. and any additives are charged in the vessel. Then the product is homogenized with a triple roll mill.

Comparative Examples A to F

The formulations of Comparative greases A to F are set out in Table 1 below.

TABLE 1

| | A/% wt | B/% wt | C/% wt | D/% wt | E/% wt | F/% wt |
|---|---|---|---|---|---|---|
| HVI 170[1] | 85.67 | 87.46 | 89.03 | 90.40 | 91.60 | 92.65 |
| 12-hydroxystearic acid | 12.50 | 10.94 | 9.57 | 8.37 | 7.33 | 6.41 |
| LiOH monohydrate | 1.83 | 1.60 | 1.40 | 1.23 | 1.07 | 0.94 |

[1]Mineral Oil having a viscosity at 40° C. of 110 $m^2s^{-1}$ and a viscosity index of 95 commercially available from Shell Oil Company

Examples 1 to 6

The formulations of Examples 1 to 6 according to the present invention are set out in Table 2 below.

TABLE 2

| | 1/% wt | 2/% wt | 3/% wt | 4/% wt | 5/% wt | 6/% wt |
|---|---|---|---|---|---|---|
| HVI 170[1] | 84.79 | 86.68 | 88.35 | 89.81 | 91.09 | 92.19 |
| 12-hydroxystearic acid | 10.60 | 9.28 | 8.12 | 7.10 | 6.21 | 5.44 |
| LiOH monohydrate | 1.96 | 1.72 | 1.50 | 1.31 | 1.15 | 1.01 |
| Isostearic acid | 2.65 | 2.32 | 2.03 | 1.78 | 1.55 | 1.36 |

[1]Mineral Oil having a viscosity at 40° C. of 110 $m^2s^{-1}$ and a viscosity index of 95 commercially available from Shell Oil Company

Examples 7 to 12

The formulations of Examples 7 to 12 according to the present invention are set out in Table 3 below.

TABLE 3

| | 7/% wt | 8/% wt | 9/% wt | 10/% wt | 11/% wt | 12/% wt |
|---|---|---|---|---|---|---|
| HVI 170[1] | 82.14 | 84.36 | 86.32 | 88.03 | 89.54 | 90.83 |
| 12-hydroxystearic acid | 10.60 | 9.28 | 8.12 | 7.10 | 6.21 | 5.44 |

TABLE 3-continued

| | 7/% wt | 8/% wt | 9/% wt | 10/% wt | 11/% wt | 12/% wt |
|---|---|---|---|---|---|---|
| LiOH monohydrate | 1.96 | 1.72 | 1.50 | 1.31 | 1.15 | 1.01 |
| Isostearic acid | 2.65 | 2.32 | 2.03 | 1.78 | 1.55 | 1.36 |
| Lupolene PE LD 1800S[2] | 2.65 | 2.32 | 2.03 | 1.78 | 1.55 | 1.36 |

[1]Mineral Oil having a viscosity at 40° C. of 110 $m^2s^{-1}$ and a viscosity index of 95 commercially available from Shell Oil Company
[2]polyethylene polymer commercially available from Ultrapolymers Deutschland GmbH

Measurement of Lubrication Properties

The greases of Examples 1 to 12 and Comparative Examples A to F were subjected to various standard test methods in order to measure a variety of different lubrication properties. The various test methods used are listed below.

Unworked penetration was measured using DIN ISO 2137.

Worked penetration was measured using DIN ISO 2137.

Worked penetration after rolltest was measured using ISO 2137/ASTM-D1831.

Worked penetration differential was measured using ISO 2137/ASTM-D1831.

Oil bleeding was measured using DIN 51817.

Spreading behaviour was measured using DIN 58397-2.

The test methods used to measure oil separation under pressure and soap layer thickness under pressure can be found in the Operation Manual from Willy Vogel AG, Berlin, Germany entitled "Fettl-Testgerat FTG 2 each Vogel/Marawe "Profgerat fur die Ertmittlung der Olausscheidun bel Fettschmierstoffen unter Druckbelastung" mit dem Nachweis der Eindickeraushartung". The apparatus and test method is also described in the following two publications: Tribologie und Schmierungstechnik, 41. Jahrgang, April 1994, pages 209-212 and Tribologie und Schmierungstechnik, 42. Jahrgang, June 1995, pages 306-310.

The results of these measurements are shown in Tables 4, 5 and 6 below.

TABLE 4

(Results for Comparative Examples A to F)

| | A | B | C | D | E | F |
|---|---|---|---|---|---|---|
| Unworked penetration (0.1 mm)[3] | 217 | 239 | 262 | 288 | 314 | 329 |
| Worked penetration (0.1 mm)[3] | 228 | 245 | 266 | 288 | 313 | 332 |
| Worked penetration after rolltest (0.1 mm)[4] | 332 | 352 | 343 | 409 | 387 | 415 |
| Worked penetration differential after rolltest (0.1 mm)[4] | 104 | 107 | 77 | 121 | 74 | 83 |
| Oil bleeding (wt %)[5] | 0.5 | 1.0 | 1.5 | 2.8 | 4.9 | 6.6 |
| Oil bleeding (wt %)[6] | 0.7 | 1.5 | 2.7 | 6.3 | 11.6 | 15.8 |
| Oil bleeding (wt %)[7] | 4.7 | 7.1 | 11.6 | 17.8 | 25.3 | 31.7 |
| Oil bleeding (wt %)[8] | 7.8 | 12.7 | 20.3 | 29.9 | 38.1 | 44.9 |

TABLE 4-continued (Results for Comparative Examples A to F)

| | A | B | C | D | E | F |
|---|---|---|---|---|---|---|
| Spreading behaviour (hours)[9] | 2.80 | 2.30 | 1.89 | 1.56 | 1.52 | 1.53 |
| Oil separation under pressure ($mm^3$) | 1189 | 1391 | 1475 | 1696 | 1836 | 2061 |
| Soap layer thickness under pressure (mm) | 3.25 | 3.33 | 2.91 | 2.97 | 2.52 | 2.57 |

[3]measured at 25° C.
[4]carried out at 80° C. for 50 hours
[5]carried out at 40° C. for 18 hours
[6]carried out at 40° C. for 7 days
[7]carried out at 120° C. for 18 hours
[8]carried out at 120° C. for 7 days
[9]carried out at 40° C.

TABLE 5

(Results for Examples 1 to 6)

| | 1 | 2 | 3 | 4 | 5 | 6 |
|---|---|---|---|---|---|---|
| Unworked penetration (0.1 mm)[3] | 227 | 253 | 267 | 288 | 313 | 330 |
| Worked penetration (0.1 mm)[3] | 238 | 261 | 279 | 303 | 325 | 340 |
| Worked penetration after rolltest (0.1 mm)[4] | 285 | 307 | 335 | 343 | 335 | 365 |
| Worked penetration differential after rolltest (0.1 mm)[4] | 47 | 46 | 56 | 40 | 10 | 25 |
| Oil bleeding (wt %)[5] | 0.3 | 0.5 | 0.8 | 1.4 | 2.1 | 3.3 |
| Oil bleeding (wt %)[6] | 0.2 | 0.8 | 1.9 | 3.9 | 6.6 | 10.4 |
| Oil bleeding (wt %)[7] | 3.6 | 5.4 | 8.1 | 11.5 | 14.6 | 20.5 |
| Oil bleeding (wt %)[8] | 11.0 | 16.8 | 23.3 | 30.6 | 38.0 | 44.8 |
| Spreading behaviour (hours)[9] | 4.81 | 3.75 | 3.15 | 2.66 | 2.22 | 1.91 |
| Oil separation under pressure ($mm^3$) | 508 | 532 | 591 | 643 | 742 | 859 |
| Soap layer thickness under pressure (mm) | 0.81 | 0.73 | 0.72 | 0.64 | 0.59 | 0.54 |

[3]measured at 25° C.
[4]carried out at 80° C. for 50 hours
[5]carried out at 40° C. for 18 hours
[6]carried out at 40° C. for 7 days
[7]carried out at 120° C. for 18 hours
[8]carried out at 120° C. for 7 days
[9]carried out at 40° C.

TABLE 6

(Results for Examples 7 to 12)

| | 7 | 8 | 9 | 10 | 11 | 12 |
|---|---|---|---|---|---|---|
| Unworked penetration (0.1 mm)[3] | 196 | 218 | 250 | 281 | 301 | 323 |
| Worked penetration (0.1 mm)[3] | 214 | 239 | 263 | 291 | 316 | 334 |
| Worked penetration after rolltest (0.1 mm)[4] | 240 | 273 | 305 | 323 | 343 | 359 |
| Worked penetration differential after rolltest (0.1 mm)[4] | 26 | 34 | 42 | 32 | 27 | 25 |
| Oil bleeding (wt %)[5] | 0.1 | 0.2 | 0.3 | 0.9 | 1.5 | 2.2 |
| Oil bleeding (wt %)[6] | 0.1 | 0.2 | 0.6 | 2.7 | 4.7 | 6.9 |
| Oil bleeding (wt %)[7] | 1.8 | 3.2 | 4.8 | 7.8 | 10.8 | 14.1 |
| Oil bleeding (wt %)[8] | 6.4 | 11.5 | 16.3 | 26.3 | 33.7 | 39.5 |
| Spreading behaviour (hours)[9] | 7.37 | 5.29 | 3.86 | 3.10 | 2.57 | 2.28 |
| Oil separation under pressure ($mm^3$) | 361 | 434 | 488 | 519 | 578 | 645 |
| Soap layer thickness under pressure (mm) | 0.95 | 0.84 | 0.81 | 0.72 | 0.60 | 0.52 |

[3]measured at 25° C.
[4]carried out at 80° C. for 50 hours
[5]carried out at 40° C. for 18 hours
[6]carried out at 40° C. for 7 days
[7]carried out at 120° C. for 18 hours
[8]carried out at 120° C. for 7 days
[9]carried out at 40° C.

The results shown in Tables 4, 5 and 6 are shown graphically in FIGS. 1 to 6. In each Figure the x axis is worked penetration. The higher the worked penetration, the softer the grease. Each line on the graphs represents a regression line of the data points for each of the greases indicated. In each Figure there is shown three regression lines; one for Comparative Examples A to F, one for Examples 1 to 6 and one for Examples 7 to 12.

FIG. 1 demonstrates the shear stability of the grease formulations tested.

Discussion

Figure 1:
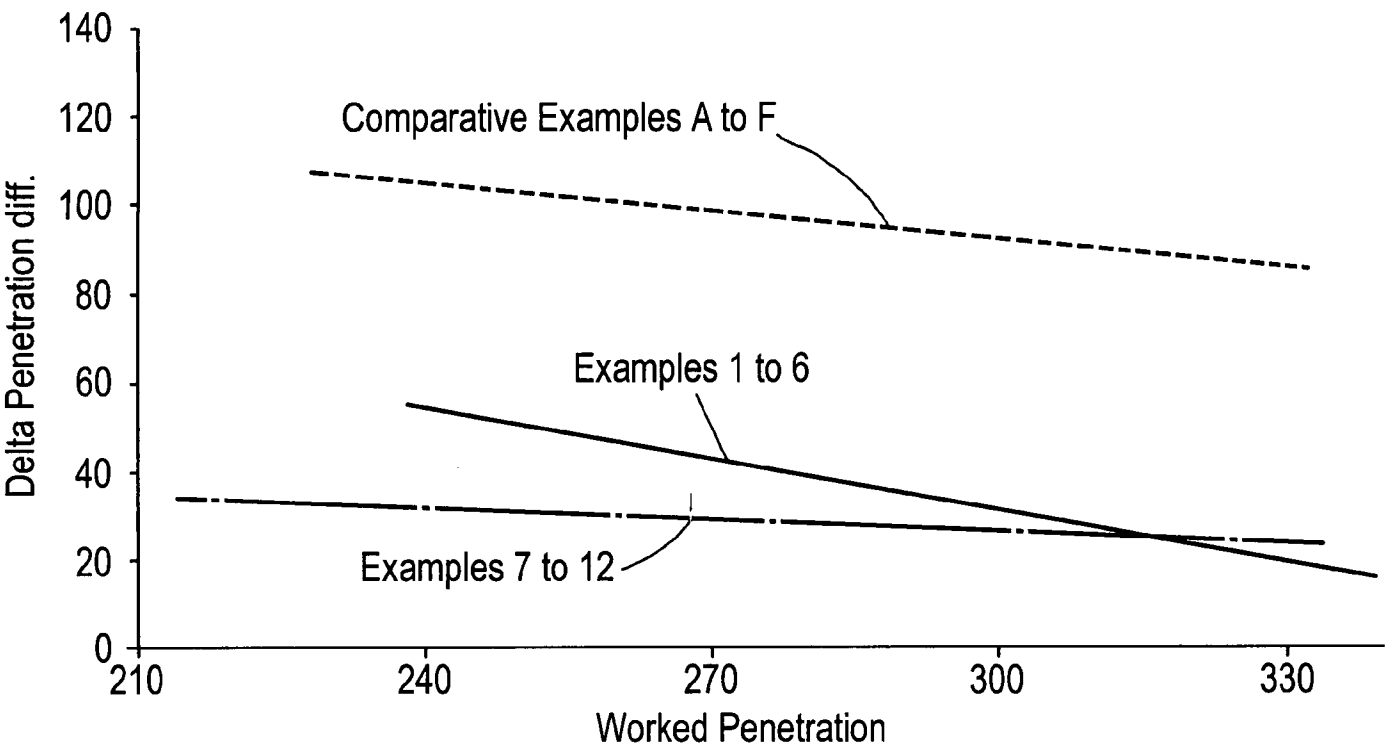
FIG. 1 is a plot of worked penetration differential after rolltest (y axis) versus worked penetration (x axis) for each of the greases tested.
Figure 2:
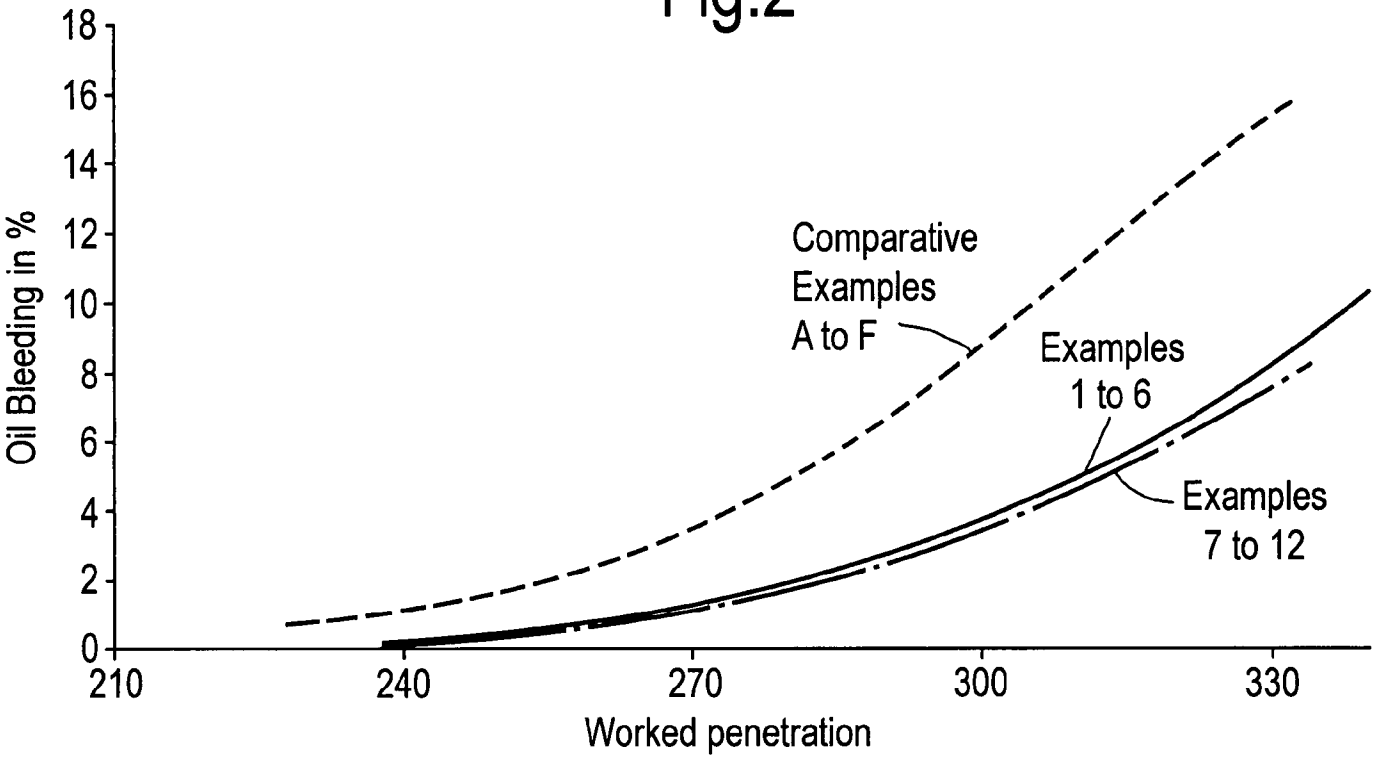
FIG. 2 is a plot of Oil Bleeding in % (measured at 40° C. for 7 days) (y axis) versus worked penetration (x axis) for each of the greases tested.
Figure 3:
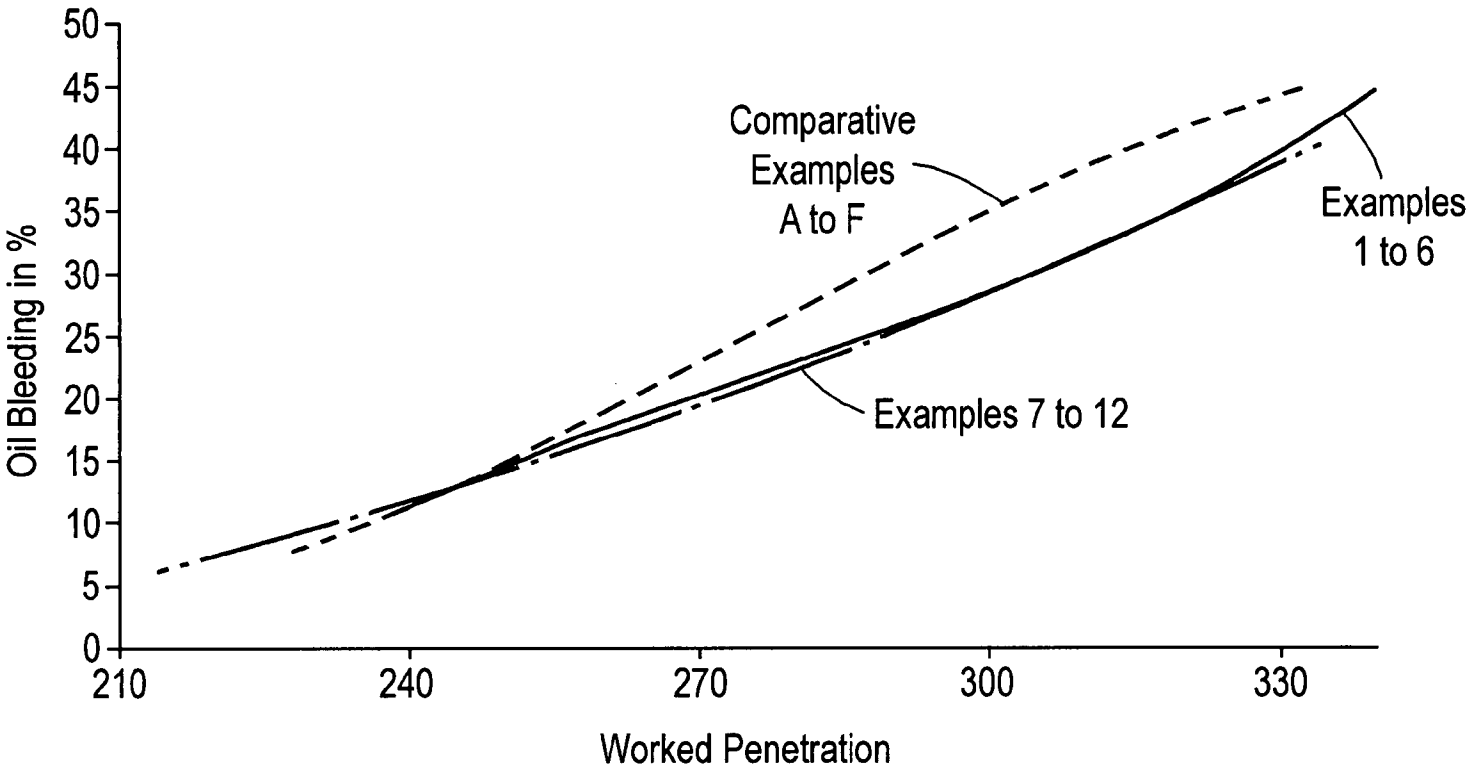
FIG. 3 is a plot of Oil Bleeding (measured at 120° C. for 7 days) (y axis) versus worked penetration (x axis).
Figure 4:
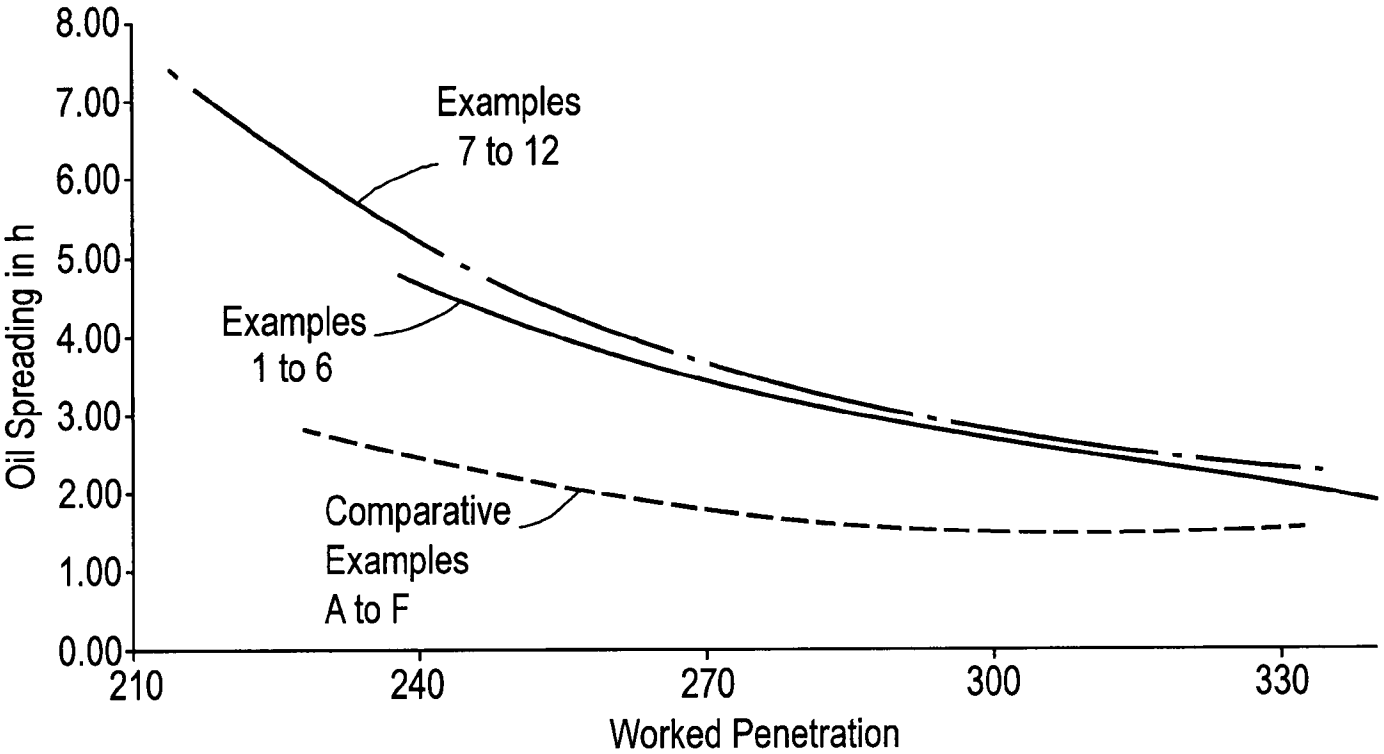
FIG. 4 is a plot of Oil Spreading (in hours) (y axis) versus worked penetration (x axis).
Figure 5:
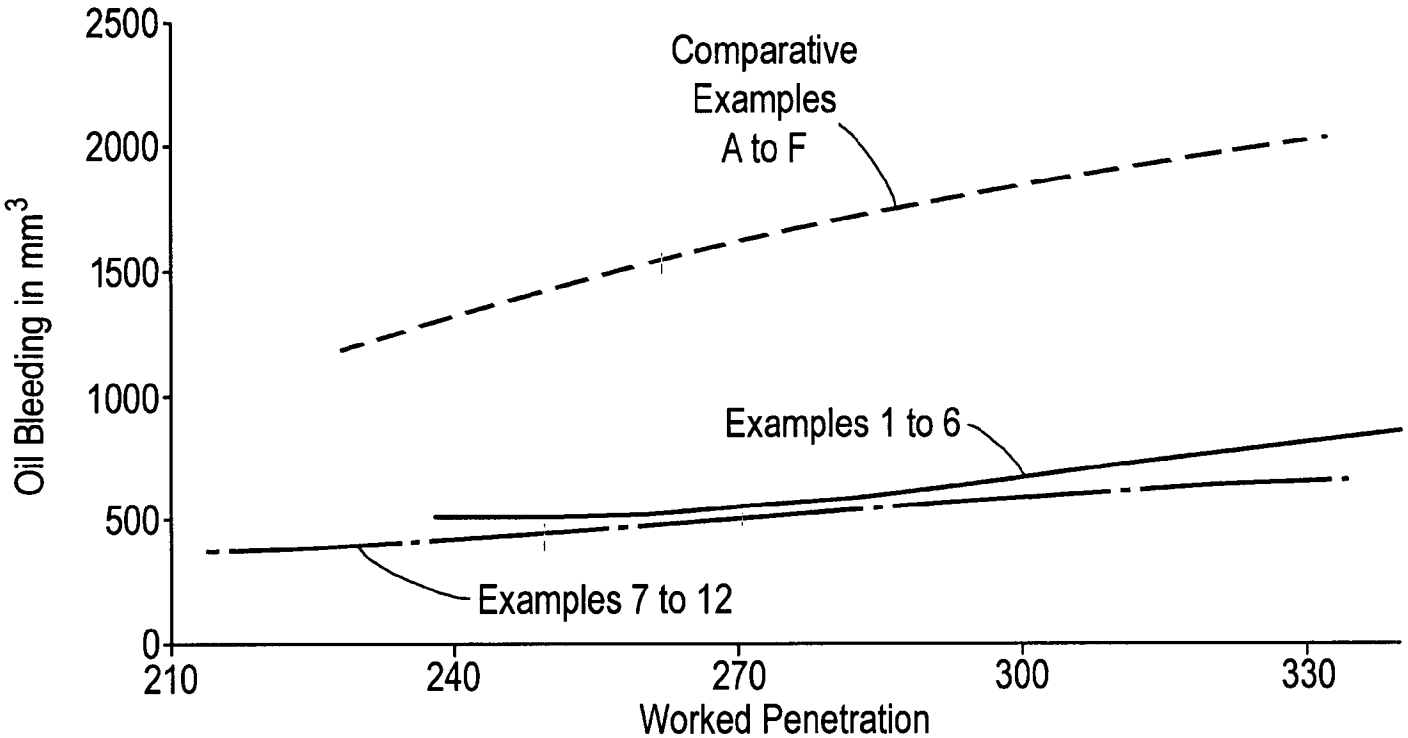
FIG. 5 is a plot of Oil separation under pressure (y axis) versus worked penetration (x axis).
Figure 6:
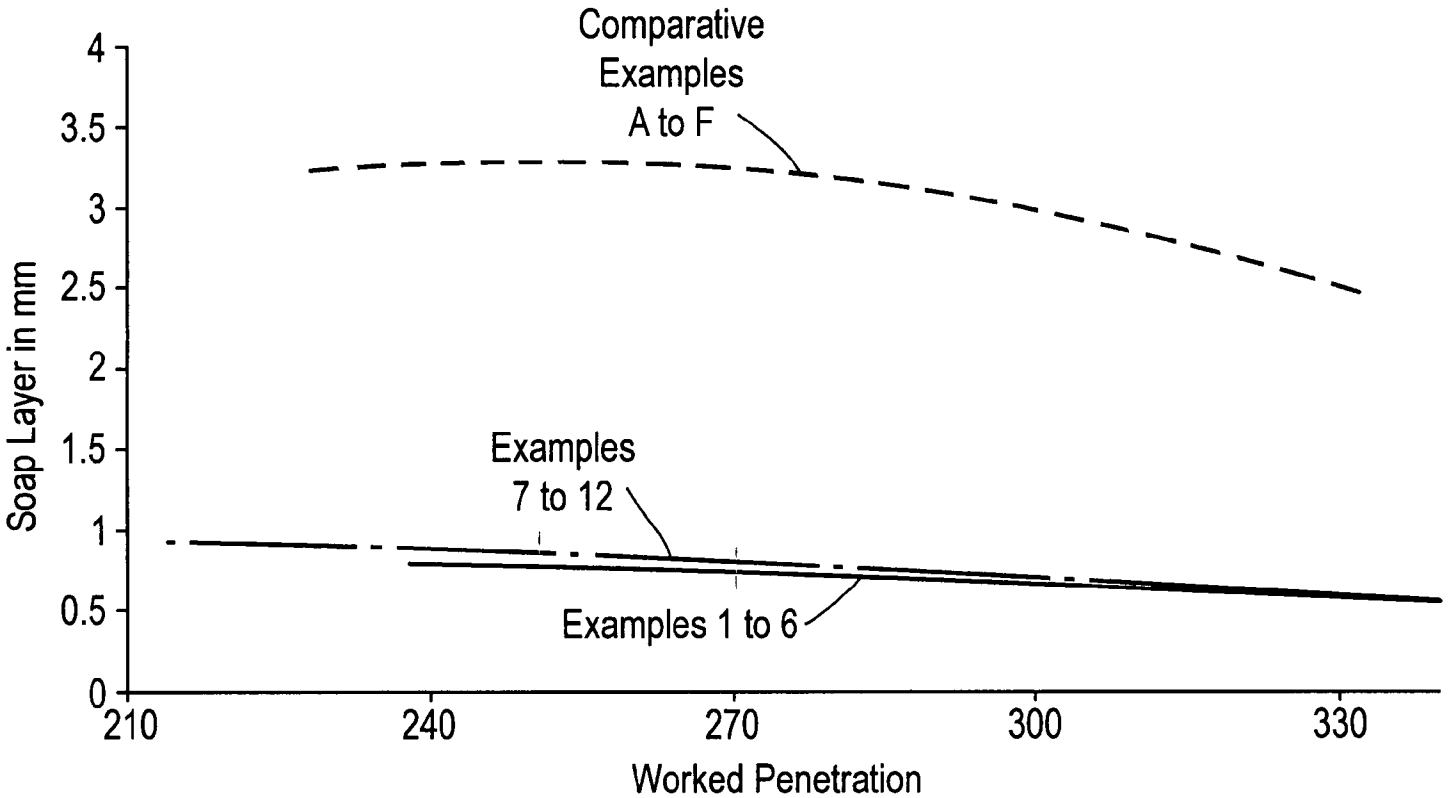
FIG. 6 is a plot of soap layer thickness under pressure (in mm) (y axis) against worked penetration (x axis).

It can be seen from the data in Tables 4 to 6 and from FIGS. 1 to 6 that the greases according to the present invention (containing lithium salts of isostearic acid and 12-hydroxystearic acid) provide improved lubrication properties, in particular, improved shear stability, oil bleeding, oil spreading and oil separation properties compared to conventional greases (containing a lithium salt of 12-hydroxystearic acid, but no lithium salt of isostearic acid). It can also be seen from FIGS. 1 to 6 that greases containing a small amount of polymer, in addition to a thickener system containing lithium salts of isostearic acid and 12-hydroxystearic acid, in general, show improved lubrication properties (improved shear stability, reduced oil bleeding, improved oil spreading, reduced oil separation) compared to greases containing lithium salts of isostearic acid and 12-hydroxystearic acid but no polymer.

That which is claimed is:

1. A lubricating grease composition comprising:

(a) a base oil;

(b) a thickener system comprising (i) a lithium soap of a first carboxylic acid selected from a $C_{12}$-$C_{24}$ hydroxy carboxylic acid and (ii) a lithium soap of a second carboxylic acid selected from a branched $C_{12}$-$C_{24}$ carboxylic acid; and (c) a polymer selected from polymers and copolymers of ethylene and olefins, and polymers and copolymers of acrylic acid.

2. The lubricating grease composition according to claim 1 wherein the hydroxy carboxylic acid is a $C_{16}$ to $C_{20}$ hydroxy carboxylic acid.

3. The lubricating grease composition according to claim 2 wherein the hydroxy carboxylic acid is a hydroxystearic acid.

4. The lubricating grease composition according to claim 3 wherein the hydroxy carboxylic acid is 12-hydroxystearic acid.

5. The lubricating grease composition according to claim 1 wherein the branched carboxylic acid is a branched $C_{16}$ to $C_{20}$ carboxylic acid.

6. The lubricating grease composition according to claim 5 wherein the branched carboxylic acid is isostearic acid.

7. The lubricating grease composition according to claim 1 wherein the first carboxylic acid and the second carboxylic acid are present in a weight ratio of from 20:1 to 1:1.

8. The lubricating grease compositions according to claim 1 wherein the polymer has a molecular weight of from 150,000 to 700,000.

9. The lubricating grease composition according to claim 8 wherein the base oil is a mineral oil.

10. The lubricating grease composition according to claim 2 wherein the first carboxylic acid and the second carboxylic acid are present in a weight ratio of from 20:1 to 1:1.

11. The lubricating grease compositions according to claim 2 wherein the polymer has a molecular weight of from 150,000 to 700,000.

12. The lubricating grease composition according to claim 1 wherein the base oil is a mineral oil.

13. The lubricating grease composition according to claim 3 wherein the first carboxylic acid and the second carboxylic acid are present in a weight ratio of from 20:1 to 1:1.

14. The lubricating grease compositions according to claim 3 wherein the polymer has a molecular weight of from 150,000 to 700,000.

15. The lubricating grease composition according to claim 14 wherein the base oil is a mineral oil.

16. The lubricating grease composition according to claim 4 wherein the first carboxylic acid and the second carboxylic acid are present in a weight ratio of from 20:1 to 1:1.

17. The lubricating grease compositions according to claim 4 wherein the polymer has a molecular weight of from 150,000 to 700,000.

18. The lubricating grease composition according to claim 17 wherein the base oil is a mineral oil.

19. The lubricating grease composition according to claim 5 wherein the first carboxylic acid and the second carboxylic acid are present in a weight ratio of from 20:1 to 1:1.

20. The lubricating grease compositions according to claim 5 wherein the polymer has a molecular weight of from 150,000 to 700,000.

21. The lubricating grease composition according to claim 20 wherein the base oil is a mineral oil.

22. The lubricating grease composition according to claim 6 wherein the first carboxylic acid and the second carboxylic acid are present in a weight ratio of from 20:1 to 1:1.

23. The lubricating grease compositions according to claim 6 wherein the polymer has a molecular weight of from 150,000 to 700,000.

24. The lubricating grease composition according to claim 23 wherein the base oil is a mineral oil.

25. The lubricating grease composition according to claim 1 wherein the polymer is present in an amount of from 0.01% to 10% by weight of the composition.

26. A method comprising:

applying a lubricating grease composition to a surface in relative movement to another surface, wherein the lubricating grease composition comprises:

(a) a base oil;

(b) a thickener system comprising (i) a lithium soap of a first carboxylic acid selected from a $C_{12}$-$C_{24}$ hydroxy carboxylic acid and (ii) a lithium soap of a second carboxylic acid selected from a branched $C_{12}$-$C_{24}$ carboxylic acid; and (c) a polymer selected from polymers and copolymers of ethylene and olefins, and polymers and copolymers of acrylic acid.

27. The method according to claim 26 wherein the hydroxy carboxylic acid is 12-hydroxystearic acid.

28. The method according to claim 26 wherein the branched carboxylic acid is a branched $C_{16}$ to $C_{20}$ carboxylic acid.

29. The method according to claim 26 wherein the branched carboxylic acid is isostearic acid.

30. The method according to claim 26 wherein the first carboxylic acid and the second carboxylic acid are present in a weight ratio of from 20:1 to 1:1.

* * * * *